US011573526B2

(12) United States Patent
Muramatsu et al.

(10) Patent No.: US 11,573,526 B2
(45) Date of Patent: Feb. 7, 2023

(54) IMAGING SYSTEM HAVING AIR FLOW GENERATOR IN DEVELOPER STORAGE CONTAINER

(71) Applicant: HEWLETT-PACKARD DEVELOPMENT COMPANY, L.P., Spring, TX (US)

(72) Inventors: Satoshi Muramatsu, Yokohama (JP); Shinichiro Suzukawa, Yokohama (JP); Tadao Mori, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/291,552

(22) PCT Filed: Nov. 15, 2019

(86) PCT No.: PCT/US2019/061726
§ 371 (c)(1),
(2) Date: May 5, 2021

(87) PCT Pub. No.: WO2020/146048
PCT Pub. Date: Jul. 16, 2020

(65) Prior Publication Data

US 2022/0026848 A1 Jan. 27, 2022

(30) Foreign Application Priority Data

Jan. 11, 2019 (JP) ..... JP2019-003577

(51) Int. Cl.
*G03G 15/08* (2006.01)
*G03G 21/20* (2006.01)
*G03G 15/095* (2006.01)

(52) U.S. Cl.
CPC ..... *G03G 21/206* (2013.01); *G03G 15/0815* (2013.01); *G03G 15/095* (2013.01); *G03G 2221/1645* (2013.01)

(58) Field of Classification Search
CPC ..... G03G 15/0815; G03G 15/095; G03G 21/0052; G03G 21/206; G03G 2221/1645
(Continued)

(56) References Cited

U.S. PATENT DOCUMENTS 8,494,403 B2 * 7/2013 Park ..... G03G 15/0813 399/99
2005/0095028 A1 * 5/2005 Lee ..... G03G 15/0898 399/98
(Continued)

FOREIGN PATENT DOCUMENTS

EP 1528438 A2 5/2005
EP 2947516 A1 11/2015
(Continued)

*Primary Examiner* — Robert B Beatty
(74) *Attorney, Agent, or Firm* — Foley & Lardner LLP

(57) ABSTRACT

An imaging system includes a rotatable image carrier; a rotatable developer carrier, a storage container, and an air flow generator. The developer carrier transfers toner to the image carrier at a developing region located between the image carrier and the developer carrier. The storage container stores the developer carrier. The air flow generator is separated from the storage container by a gap, and rotates in a rotational direction that is opposite to a rotational direction of the developer carrier, to channel an air flow through the gap when the air flow generator rotates.

16 Claims, 22 Drawing Sheets

(58) Field of Classification Search
USPC ..... 399/92, 98
See application file for complete search history.

(56) References Cited

U.S. PATENT DOCUMENTS

| | | | | |
|---|---|---|---|---|
| 2011/0097103 | A1 | 4/2011 | Park | |
| 2016/0370729 | A1* | 12/2016 | Ikebata | G03G 15/0812 |
| 2019/0129332 | A1* | 5/2019 | Muramatsu | G03G 15/0898 |
| 2019/0317430 | A1* | 10/2019 | Morimoto | G03G 15/0942 |

FOREIGN PATENT DOCUMENTS

| | | | |
|---|---|---|---|
| EP | 3598238 | A1 | 1/2020 |
| JP | 1984170868 | | 9/1984 |
| JP | 1985008868 | | 1/1985 |
| JP | 2002174951 | | 6/2002 |
| JP | 2004-138908 | A | 5/2004 |
| JP | 2009116198 | A | 5/2009 |
| JP | 2015230344 | | 12/2015 |
| KR | 0577690 | | 5/2006 |
| KR | 20150122684 | A | 11/2015 |
| WO | 2018/124408 | A1 | 7/2018 |

* cited by examiner

| AIR FLOW GENERATOR | SAMPLE a | SAMPLE b | SAMPLE c | SAMPLE d | SAMPLE e |
|---|---|---|---|---|---|
| CROSS-SECTIONAL SHAPE |  |  |  |  |  |
| SPACE CROSS-SECTIONAL RATIO | 0.03 | 0.15 | 0.3 | 0.2 | 0.35 |

| AIR FLOW GENERATOR | SAMPLE f | SAMPLE g | SAMPLE h |
|---|---|---|---|
| SHAPE |  |  |  |
| Air FEED AMOUNT $mm^3/min$ | 0 | 150 | 200 |

IMAGING SYSTEM HAVING AIR FLOW GENERATOR IN DEVELOPER STORAGE CONTAINER

CROSS REFERENCE TO RELATED APPLICATIONS

This application is filed under 35 U.S.C. 0.371 as a National Stage of PCT International Application No. PCT/US2019/061726, filed on Nov. 15, 2019, in the U.S. Patent and Trademark Office, which claims the priority benefit of Japanese Patent Application No. 2019-003577, filed on Jan. 11, 2019, in the Japan Patent Office. The disclosures of PCT International Application No. PCT/US2019/061726 and Japanese Patent Application No. 2019-003577 are incorporated by reference herein in their entireties.

BACKGROUND

In some imaging systems, equipped with a toner moving mechanism that includes a developing device body and a developing sleeve, a flow passage forming member has an elongated shape along a rotational direction of the developing sleeve between an inner wall of the developing device body and the developing sleeve, in order to prevent an air pressure inside the developing device body from being increased and to prevent toner from being scattered to the outside of the developing device body.

BRIEF DESCRIPTION OF DRAWINGS

FIG. 8(*b*) is a cross-sectional view of an example air flow generator.

FIG. 8(*c*) is a cross-sectional view of an example air flow generator.

FIG. 8(*d*) is a cross-sectional view of an example air flow generator.

FIG. 20(*b*) is a partial perspective view of a part of a paddle forming portion of the air flow generator illustrated in FIG. 19.

FIG. 20(*c*) is a perspective view of a part of a second blade forming portion of the air flow generator illustrated in FIG. 19.

DETAILED DESCRIPTION

An example imaging system will be described with reference to the drawings. The imaging system may include an imaging apparatus such as a printer, or a developing device used in an imaging apparatus or the like. In the following description, with reference to the drawings, the same reference numbers are assigned to the same components or to similar components having the same function, and overlapping description is omitted.

Figure 1:
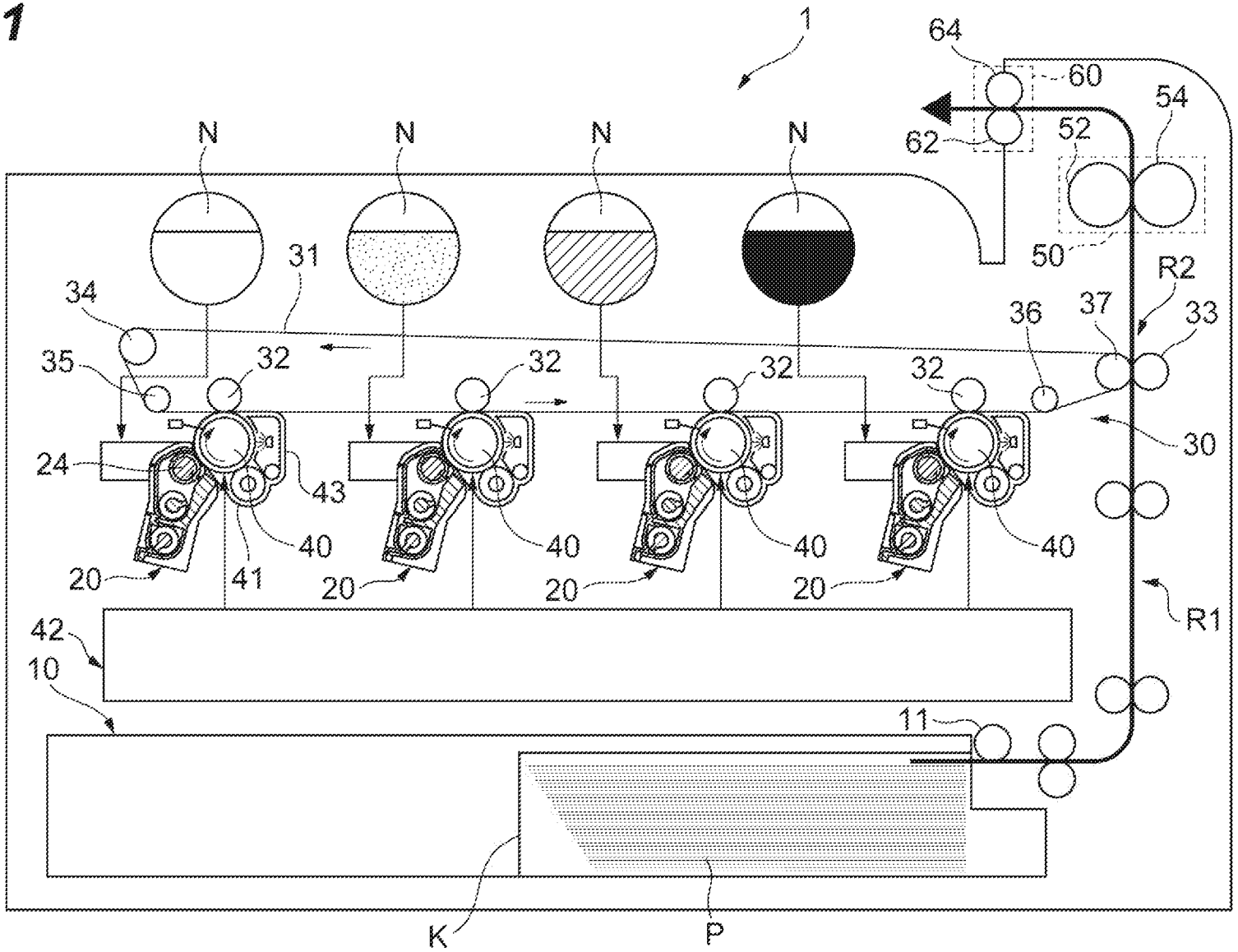
FIG. 1 is a schematic diagram of an example imaging apparatus, including example developing devices.

With reference to FIG. 1, an example imaging apparatus 1 may form a color image by using four colors of magenta, yellow, cyan, and black. The imaging apparatus 1 may include a conveying device 10 to convey a sheet P corresponding to a printing medium, a developing device 20 develop an electrostatic latent image, a transfer device 30 secondarily transfer a toner image onto the sheet P, an image carrier 40 to form an electrostatic latent image on a surface (a circumferential surface) thereof, a fixing device 50 to fix a toner image to the sheet P, and a discharging device 60 to discharge the sheet P.

The conveying device 10 may convey the sheet P which is a printing medium having an image formed thereon, on a conveying route R1. The sheets P may be stacked and accommodated in a cassette K and picked up and conveyed by a feeding roller 11. The conveying device 10 may convey the sheet P to reach a transfer nip region R2 through the conveying route R1 at a timing at which a toner image transferred onto the sheet P reaches the transfer nip region R2.

Four developing devices 20 may be provided so as to correspond to the respective colors of magenta, yellow, cyan, and black. Each developing device 20 may include a developer carrier 24 to carry toner on the image carrier 40. In the developing device 20, a two-element developer including toner and carrier may be used as a developer. For example, in the developing device 20, the toner and the carrier may be adjusted to have a predetermined or selected mixing ratio and may be mixed to uniformly disperse the toner, to achieve target charge amount (e.g. an optimal charged amount) of the developer. The developer is carried by the developer carrier 24. When the developer is conveyed to a developing region R4 (see FIG. 2) facing the image carrier 40 by the rotation of the developer carrier 24, the toner of the developer carried by the developer carrier 24 moves to the electrostatic latent image formed on the circumferential surface of the image carrier 40, so that the electrostatic latent image is developed.

The sheet P may be conveyed to the transfer nip region R2 in which the toner image formed by the developing device 20 is secondarily transferred onto the sheet P by the transfer device 30. The transfer device 30 may include a transfer belt 31 onto which a toner image is primarily transferred from the image carrier 40, tension rollers 34, 35, 36, and 37 which tension the transfer belt 31, a primary transfer roller 32 which sandwiches the transfer belt 31 between the primary transfer roller 32 and the image carrier 40, and a secondary transfer roller 33 which sandwiches the transfer belt 31 between the secondary transfer roller 33 and the tension roller 37.

The transfer belt 31 may be an endless belt which moves in a circulating manner by the tension rollers 34, 35, 36, and 37. Each of the tension rollers 34, 35, 36, and 37 is rotatable about a corresponding rotation axis. The tension roller 37 may be a drive roller which rotates about an axis in a driving manner and each of the tension rollers 34, 35, and 36 may be a driven roller which rotates in a driven manner by the rotational driving of the tension roller 37. The primary transfer roller 32 may press against the image carrier 40 from the inner circumferential side of the transfer belt 31. The secondary transfer roller 33 may be disposed in parallel to the tension roller 37 with the transfer belt 31 interposed therebetween. The secondary transfer roller 33 may press against the tension roller 37 from the outer circumferential side of the transfer belt 31. Accordingly, the secondary transfer roller 33 forms the transfer nip region R2 between the secondary transfer roller and the transfer belt 31.

The image carrier 40 may be referred to as an electrostatic latent image carrier, a photoconductor drum, or the like. Four image carriers 40 may be provided at respective four positions, corresponding to the respective colors. The image carriers 40 are arranged along the movement direction of the transfer belt 31. The developing device 20, a charging roller 41, an exposure unit 42, and a cleaning unit 43 may be provided on the circumference of the image carrier 40.

The charging roller 41 may uniformly charge a surface of the image carrier 40 to a predetermined potential. The charging roller 41 may move to follow the rotation of the image carrier 40. The exposure unit 42 may expose the surface of the image carrier 40 charged by the charging roller 41 in response to an image formed on the sheet P. Accordingly, a potential of a portion exposed by the exposure unit 42 in the surface of the image carrier 40 changes, so that an electrostatic latent image is formed. The four developing devices 20 generate a toner image by developing the electrostatic latent image formed on the image carrier 40 by the toner supplied from each toner tank N which face the respective developing devices 20. The toner tanks N are respectively filled with toner of magenta, yellow, cyan, and black. The cleaning unit 43 may collect the toner remaining on the image carrier 40 after the toner image formed on the image carrier 40 is primarily transferred onto the transfer belt 31.

The fixing device 50 may cause the sheet P to pass through a fixing nip region for heating and pressing the sheet so that the toner image secondarily transferred from the transfer belt 31 onto the sheet P is attached and fixed onto the sheet P. The fixing device 50 may include a heating roller 52 which heats the sheet P and a pressing roller 54 which rotates in a driving manner while pressing against the heating roller 52. The heating roller 52 and the pressing roller 54 have a cylindrical shape and the heating roller 52 includes a heat source such as a halogen lamp provided therein. A fixing nip region which is a contact region is formed between the heating roller 52 and the pressing roller 54. The toner image is melted and fixed onto the sheet P in such a manner that the sheet P passes through the fixing nip region.

The discharging device 60 may include discharge rollers 62 and 64 which discharge the sheet P onto which the toner image is fixed by the fixing device 50 to the outside of the apparatus.

During a printing process of the example imaging apparatus 1, when an image signal of a printing target image is input to the imaging apparatus 1, a control unit of the imaging apparatus 1 may rotate the feeding roller 11 so that the sheets P stacked on the cassette K are picked up and conveyed. Then, a surface of the image carrier 40 may be uniformly charged to a predetermined potential by the charging roller 41 (a charging operation). Subsequently, the surface of the image carrier 40 may be irradiated with a laser beam generated by the exposure unit 42 on the basis of the received image signal, so that an electrostatic latent image is formed (an exposing operation).

In the developing device 20, the electrostatic latent image may be developed, so that a toner image is formed (a developing operation). The toner image which is formed in this way may be primarily transferred from the image carrier 40 onto the transfer belt 31 in a region in which the image carrier 40 faces the transfer belt 31 (a transferring operation). The toner images formed on four image carriers 40 are sequentially superimposed or layered on the transfer belt 31, so that a single composite toner image is formed. Then, the composite toner image may be secondarily transferred onto the sheet P conveyed from the conveying device 10 in the transfer nip region R2 in which the tension roller 37 faces the secondary transfer roller 33.

The sheet P onto which the composite toner image is secondarily transferred is conveyed to the fixing device 50. Then, the fixing device 50 melts and fixes the laminated toner image onto the sheet P by heating and pressing the sheet P between the heating roller 52 and the pressing roller 54 when the sheet P passes through the fixing nip region (a fixing operation). The sheet P may be discharged to the outside of the imaging apparatus 1 by the discharge rollers 62 and 64.

Figure 2:
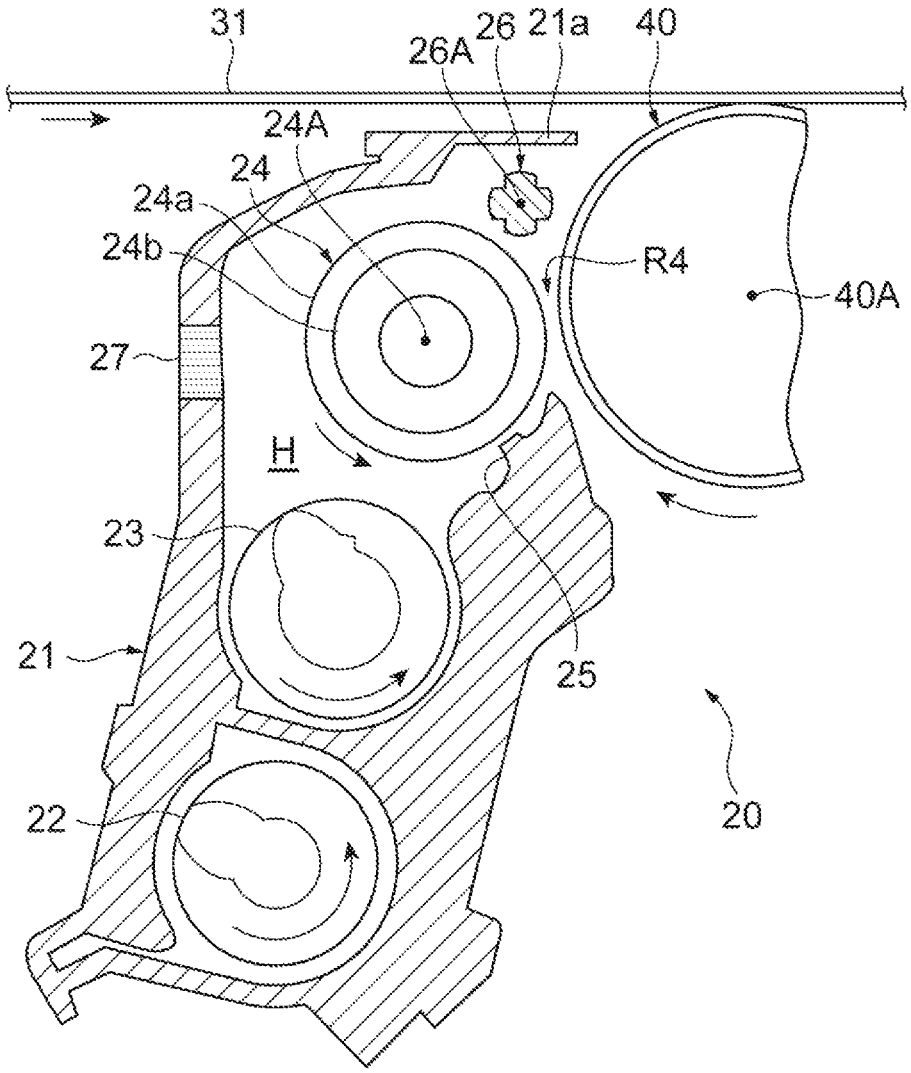
FIG. 2 is a schematic cross-sectional view of an example developing device.

With reference to FIG. 2, an example developing device 20 may include the rotatable image carrier 40, a storage container 21, a first mixing and conveying member 22, a second mixing and conveying member 23, a rotatable developer carrier 24, a carrying amount regulator 25, and a rotatable air flow generator 26.

The image carrier 40 may have a surface on which an electrostatic latent image is formed. The image carrier 40 may be rotatably supported by the storage container 21 and may be rotationally driven by a drive source (not illustrated) such as a motor. The image carrier 40 may have a columnar shape.

The storage container 21 may store a developer including toner and carrier. For example, the storage container 21 may have a developer storage chamber H which stores a developer including toner and carrier. The storage container 21 may store the first mixing and conveying member 22, the second mixing and conveying member 23, the developer carrier 24, the carrying amount regulator 25, and the air flow generator 26. The storage container 21 may include an opening at a position in which the developer carrier 24 faces the image carrier 40 and the toner inside the developer storage chamber H may be supplied from the opening to the image carrier 40. The storage container 21 may include a filter 27. The filter 27 may be provided in a through-hole formed in the storage container 21, to ventilate the inside and the outside of the storage container 21 and to prevent the passage of the developer. The storage container 21 is provided with a developer discharge port (not illustrated) through which a used developer is discharged from the developer storage chamber H.

The first mixing and conveying member 22 and the second mixing and conveying member 23 may mix magnetic carrier and non-magnetic toner constituting a developer inside the developer storage chamber H and may frictionally charge the carrier and the toner. The first mixing and conveying member 22 and the second mixing and conveying member 23 may convey the developer while mixing the developer inside the developer storage chamber H. The first mixing and conveying member 22 may be disposed on a first conveying path (not illustrated) at the bottom portion of the developer storage chamber H and the second mixing and conveying member 23 may be disposed on a second conveying path (not illustrated) at an upper stage of the first conveying path. The first conveying path and the second conveying path extend in a direction parallel to a rotational axis 24A of the developer carrier 24. The first mixing and conveying member 22 may convey the developer in a first direction along the first conveying path while mixing the developer and may supply the developer to the second conveying path. The second mixing and conveying member 23 may convey the developer supplied from the first conveying path in a second direction opposite to the first direction along the second conveying path and supplies the developer to the developer carrier 24.

The developer carrier 24 may be disposed to face the image carrier 40 so that a gap is formed between the developer carrier and the image carrier 40. The developer carrier 24 may rotate while carrying the developer stored in the storage container 21 on the surface thereof. The developer carrier 24 may have a cylindrical shape, a semi-cylindrical shape, or the like. The developer carrier 24 is disposed so that the rotational axis 24A of the developer carrier 24 are parallel to a rotational axis 40A of the image carrier 40 and a gap between the developer carrier 24 and the image carrier 40 is the same in the direction of the rotational axis 24A (the direction of the rotational axis 40A). The developer carrier 24 may carry the developer which is mixed by the first mixing and conveying member 22 and the second mixing and conveying member 23 on the surface thereof. The developer carrier 24 may develop the electrostatic latent image of the image carrier 40 by conveying the developer carried thereon to the developing region R4. The developing region R4 may be located between the developer carrier 24 and the image carrier 40 and is a region in which the developer carrier 24 faces the image carrier 40. The developing region R4 may be a region in which the developer carrier 24 is closest to the image carrier 40.

The developer carrier 24 may include a developing sleeve 24*a* which forms a surface layer of the developer carrier 24 and a magnet 24*b* which is disposed inside the developing sleeve 24*a*. The developing sleeve 24*a* may be a tubular member including a non-magnetic metal. The developing sleeve 24*a* is rotatable about the rotational axis 24A. The developing sleeve 24*a* may be rotatably supported by the magnet 24*b* and may be rotationally driven by a drive source (not illustrated) such as a motor. The magnet 24*b* may be fixed to the storage container 21 and may include a plurality of magnetic poles. The developer may be carried on the surface of the developing sleeve 24*a* by the magnetic force of the magnet 24*b*. The developer carrier 24 may convey the developer in the rotational direction of the developing sleeve 24*a* as the developing sleeve 24*a* rotates.

The developer may form spikes on the developing sleeve 24*a* by the magnetic force of each magnetic pole of the magnet 24*b*. The developer carrier 24 allows spikes of the developer formed by the magnetic pole to contact or approach the electrostatic latent image of the image carrier 40 in the developing region R4. Consequently, the toner in the developer carried on the developer carrier 24 moves to the electrostatic latent image formed on the circumferential surface of the image carrier 40 so that the electrostatic latent image is developed.

The carrying amount regulator 25 may regulate the amount of the developer carried on the developer carrier 24. The carrying amount regulator 25 is provided at the upstream side in the rotational direction of the developing sleeve 24*a* with respect to the developing region R4. The carrying amount regulator 25 may be located at the lower side in relation to the rotational axis 24A of the developer carrier 24. The carrying amount regulator 25 may form a predetermined gap between the carrying amount regulator and the developing sleeve 24*a*. Accordingly, the carrying amount regulator 25 may regulate the layer thickness of the developer carried on the circumferential surface of the developing sleeve 24*a* by rotating the developing sleeve 24*a* so that an average layer having a uniform thickness is formed. When a gap between the carrying amount regulator 25 and the developing sleeve 24*a* is adjusted, the amount of the developer of the developer carrier 24 carried to the developing region R4 can be adjusted.

The air flow generator 26 may be located between the developing region R4 and the transfer belt 31 and is spaced apart from the developer carrier 24, the image carrier 40, and the storage container 21 with a gap interposed therebetween. The air flow generator 26 may face a casing upper wall 21*a* located above the air flow generator 26 in the storage container 21. A surface at the side of the air flow generator 26 of the casing upper wall 21*a* may have a planar shape. The air flow generator 26 may be bar-shaped and extend in a direction parallel to the rotational axis 24A of the developer carrier 24.

The air flow generator 26 may be disposed near the downstream side of the developing region R4 in the rotational direction of the developer carrier 24. Accordingly, the air flow generator 26 may form an air circulation path among the developer carrier 24, the image carrier 40, and the storage container 21 so that the developer discharged from the storage container 21 is returned to the storage container 21.

Figure 3:
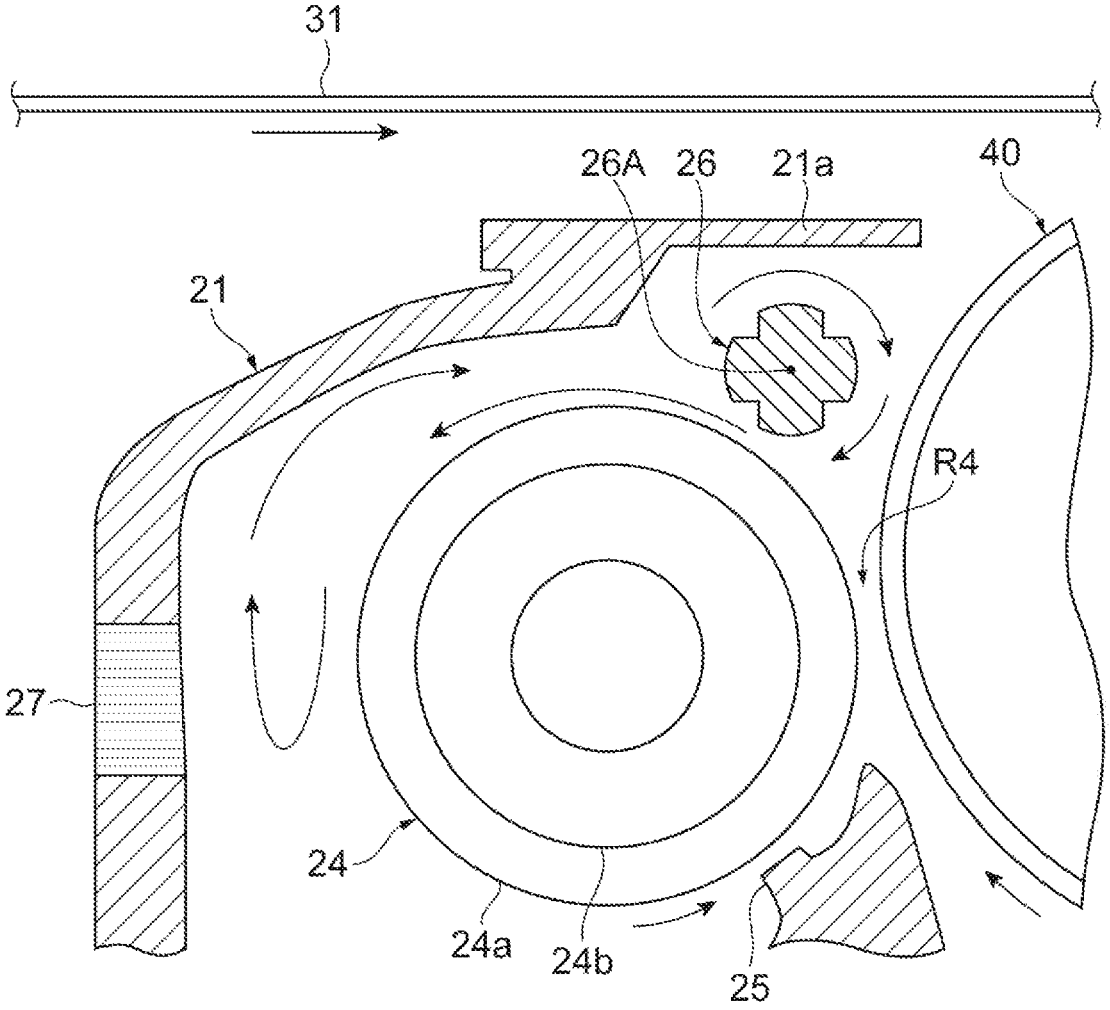
FIG. 3 is a schematic cross-sectional view illustrating a positional relationship of an image carrier, a developer carrier, a storage container, and an air flow generator in an example developing device.
Figure 4:
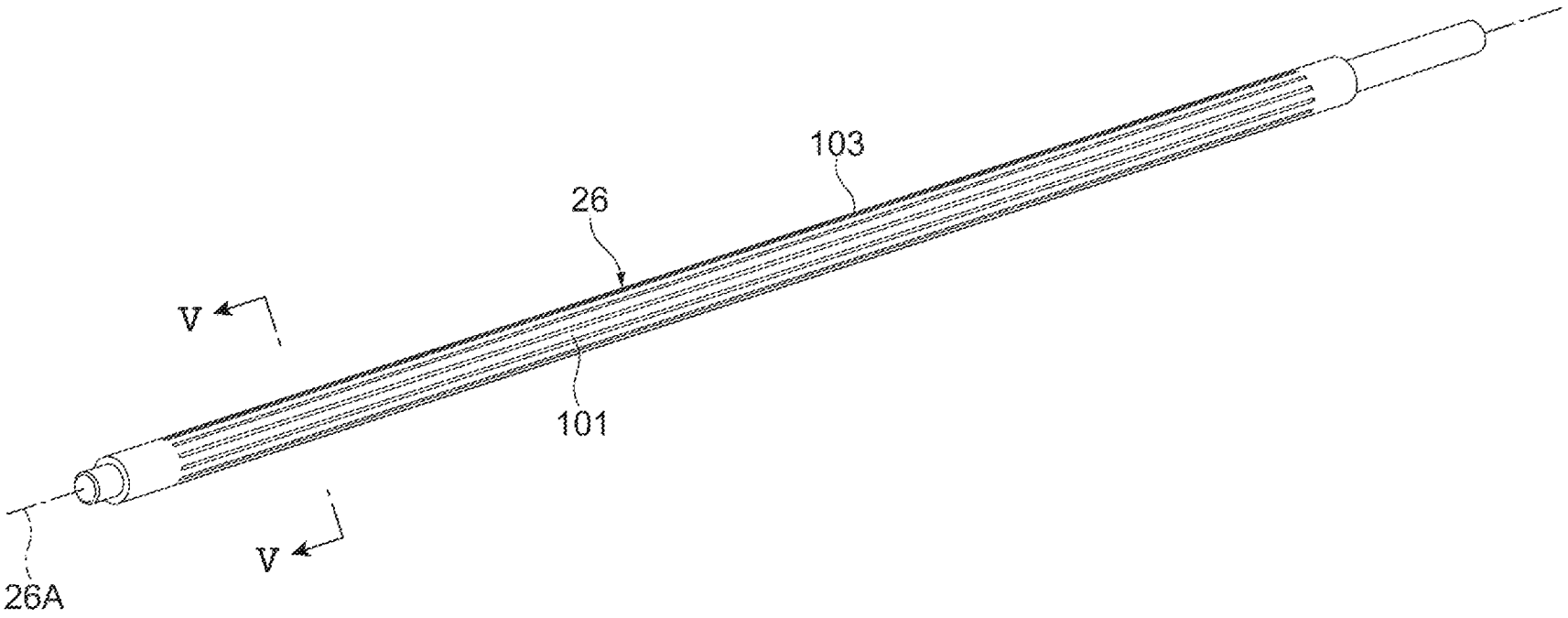
FIG. 4 is a perspective view of an example air flow generator.
Figure 5:
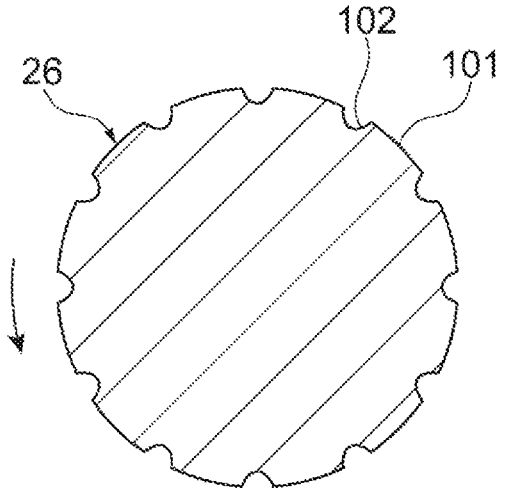
FIG. 5 is a cross-sectional view of the air flow generator illustrated in FIG. 4, taken along the line V-V.

With reference to FIG. 3, air in a gap between the air flow generator 26 and the developer carrier 24 may be received into the storage container 21 by the developer spikes while being carried on the surface of the developer carrier 24 as the developing sleeve 24*a* of the developer carrier 24 rotates. Most of the developer which is received into the storage container 21 is maintained inside the storage container 21, discharged from the storage container 21 through a gap between the air flow generator 26 and the storage container 21, and returned to a gap between the air flow generator 26 and the developer carrier 24 through a gap between the air flow generator 26 and the image carrier 40. For example, an air flow may be generated in the periphery of the air flow generator 26 so as to sequentially flow through a gap between the air flow generator 26 and the developer carrier 24, a gap between the air flow generator 26 and the storage container 21, and a gap between the air flow generator 26 and the image carrier 40.

The air flow generator 26 may cause an unevenness to form on the surface thereof and may rotate in the rotational direction opposite to the rotational direction of the developer carrier 24. For example, the air flow generator 26 may rotate in the rotational direction opposite to the rotational direction of the developer carrier 24 and may feed an air flow to a gap between the air flow generator and the storage container 21 during a rotation, to improve a circulation of air flow in the periphery of the air flow generator 26.

The air flow generator 26 may include a non-magnetic material, such as SUS304 or the like, for example.

The air flow generator 26 may be bar-shaped and extend in a direction parallel to the rotational axis 24A of the developer carrier 24 and the rotational axis 40A of the image carrier 40.

With reference to FIGS. 4 to 7, the air flow generator 26 may include a paddle 101 which rotates about a rotational axis 26A of the air flow generator 26. The paddle 101 feeds an air flow to a gap between the paddle and the storage container 21 as the air flow generator 26 rotates. In some examples, the paddle 101 may be formed in the entire region of the air flow generator 26 excluding both end portions of the air flow generator 26 in the direction along the rotational axis 26A of the air flow generator 26. A portion provided with the paddle 101 in the air flow generator 26 may be referred to as a first rod portion 103.

The paddle 101 may include a propulsion surface 102 which feeds an air flow to a gap between the paddle and the storage container 21. The propulsion surface 102 is a front surface of the paddle 101 in the rotational direction of the air flow generator 26. The shape of the propulsion surface 102 is not particularly limited. For example, the propulsion surface 102 may be flat, curved, or stepped. Further, the propulsion surface 102 may substantially extend in the radially direction with respect to the rotational axis 26A of the air flow generator 26. Further, the propulsion surface 102 may extend in parallel to the rotational axis 26A of the air flow generator 26.

Figure 6:
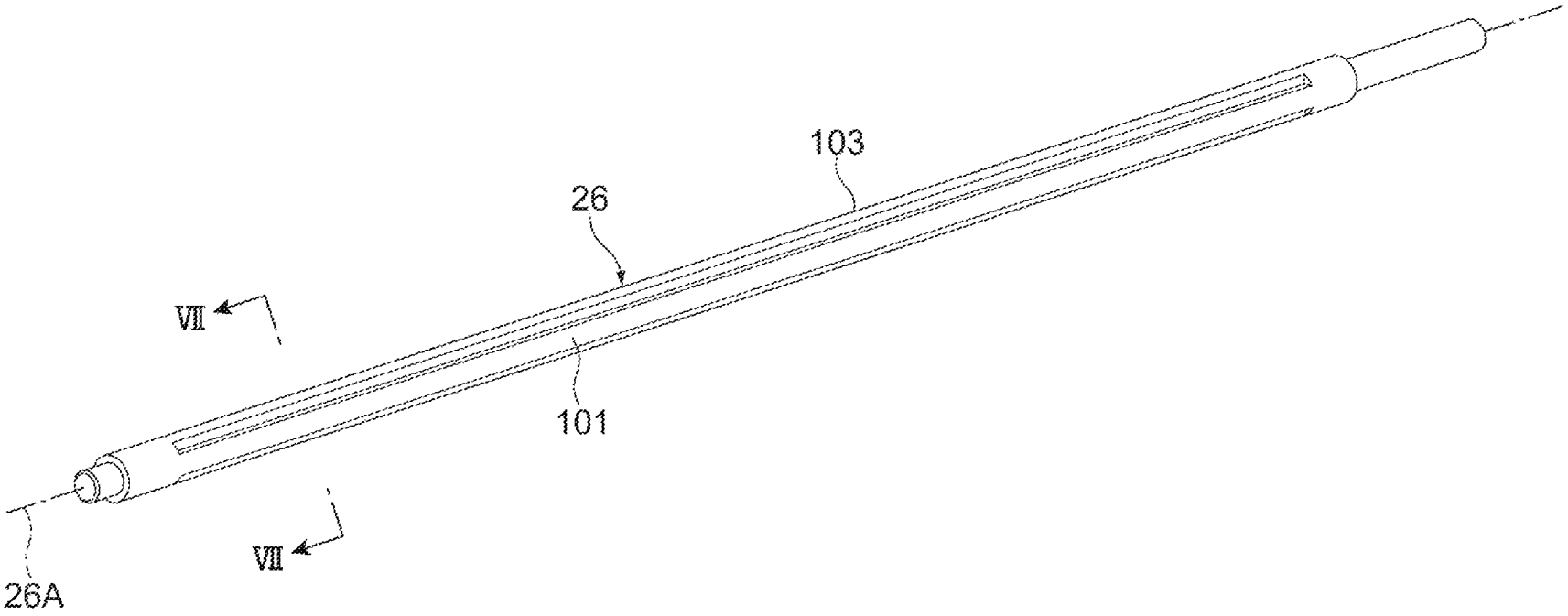
FIG. 6 is a perspective view of an example air flow generator.
Figure 7:
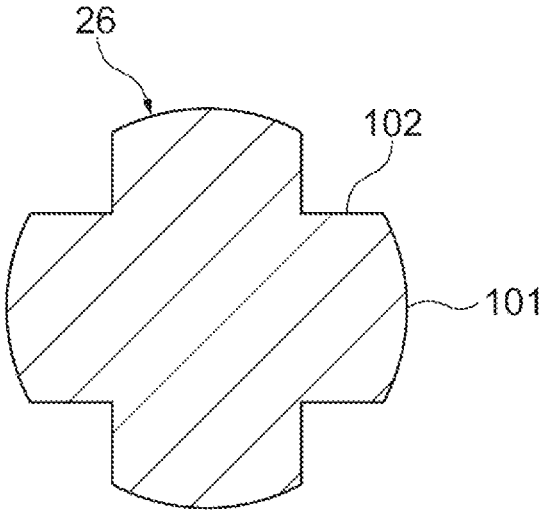
FIG. 7 is a cross-sectional view of the air flow generator illustrated in FIG. 6, taken along the line VII-VII.
Figure 8A:
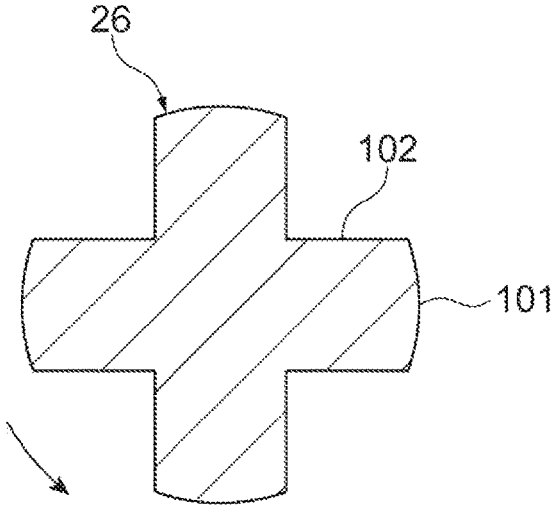
FIG. 8(*a*) is a cross-sectional view of an example air flow generator.
Figure 8B:
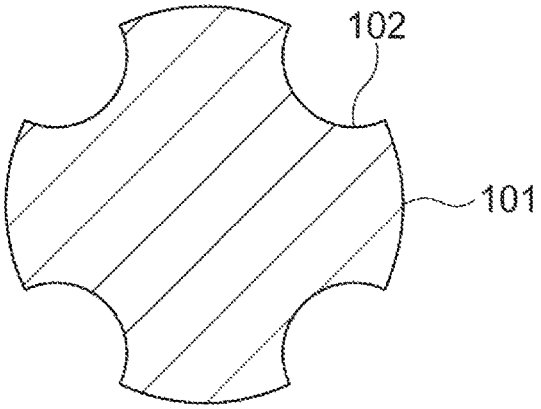
Figure 8C:
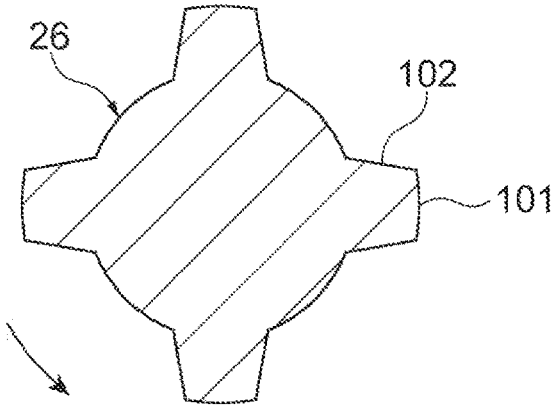
Figure 8D:
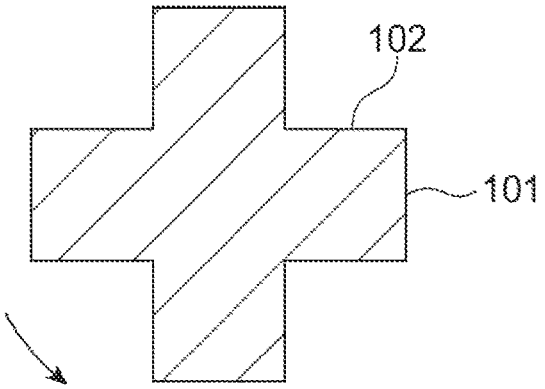

The paddle 101 is defined by a groove that extends parallel to the rotational axis 26A of the air flow generator 26 in a bar-shaped member having a circular cross-section and extending along the rotational axis 26A of the air flow generator 26. The propulsion surface 102 of the paddle 101 may extend in parallel to the rotational axis 26A of the air flow generator 26. In some examples, with reference to FIGS. 4 and 5, the air flow generator 26 may include twelve paddles 101 defined by twelve circular-arc grooves extending parallel to the rotational axis 26A of the air flow generator 26, formed in a bar-shaped member having a circular cross-section and extending along the rotational axis 26A of the air flow generator 26. In the propulsion surface 102 of the paddle 101, an end portion at the outer circumferential surface side extends substantially in the radial direction with respect to the rotational axis 26A of the air flow generator 26. With reference to FIGS. 6 and 7, an example air flow generator 26 includes four paddles 101, defined by four L-shaped grooves extending parallel to the rotational axis 26A of the air flow generator 26, formed in a bar-shaped member having a circular cross-section and extending along the rotational axis 26A of the air flow generator 26. The propulsion surface 102 of the paddle 101 extends substantially in the radial direction with respect to the rotational axis 26A of the air flow generator 26.

The number of the paddles 101 provided in the air flow generator 26 (the number of grooves formed in the bar-shaped member), the shape of the paddle 101, the size of the paddle 101, and the like are not particularly limited. In some examples, with reference to FIG. 8(*a*), an example air flow generator 26 may include four paddles 101. The four paddles 101 may be obtained by forming four L-shaped grooves parallel to the rotational axis 26A of the air flow generator 26, in a bar-shaped member that has a circular cross-section and that extends along the rotational axis 26A of the air flow generator 26, similarly to the example air flow generator 26 illustrated in FIGS. 4 and 5. In comparison to the air flow generator of FIGS. 4 and 5, the air flow generator 26 of FIG. 8(*a*) has deeper grooves and the width of the paddles 101 is narrower. With reference to FIG. 8(*b*), an example air flow generator 26 may include four paddles 101 which are obtained by forming four circular-arc grooves extending parallel to the rotational axis 26A of the air flow generator 26, in a bar-shaped member that has a circular cross-section and that extends along the rotational axis 26A of the air flow generator 26. With reference to FIG. 8(*c*), an example air flow generator 26 may include four paddles 101 which are obtained by forming four rectangular grooves extending parallel to the rotational axis 26A of the air flow generator 26, formed in a bar-shaped member that has a circular cross-section and that extends along the rotational axis 26A of the air flow generator 26. With reference to FIG. 8(*d*), an example air flow generator 26 may include four paddles 101 which are obtained by four L-shaped grooves extending parallel to the rotational axis 26A of the air flow generator 26 at four corners of a bar-shaped member that has a square cross-section and that extends along the rotational axis 26A of the air flow generator 26.

Accordingly, the air flow generator 26 feeds an air flow to a gap between the air flow generator and the storage container 21 during a rotation, in order to improve the circulation of air flow in the periphery of the air flow generator 26, and to prevent toner from being scattered from the storage container 21.

The air flow generator 26 may include the paddle 101 to further improve the circulation of air flow in the periphery of the air flow generator 26. The paddle 101 may include the propulsion surface 102 which extends substantially in the radial direction with respect to the rotational axis 26A of the air flow generator 26 and which extends in parallel to the rotational axis 26A of the air flow generator 26, in order to further improve the circulation of air flow.

The air flow generator 26 may be located near the downstream side of the developing region R4 which is the downstream side in the rotational direction of the developer carrier 24, to suitably return the toner discharged from a gap between the air flow generator 26 and the storage container 21, to the storage container 21.

Figure 9:
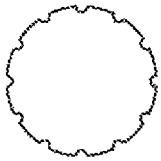
FIG. 9 is a diagram illustrating a relationship between example cross-sectional shapes of a first rod portion and a cross-sectional space ratio.
Figure 9:
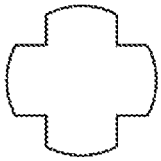
Figure 9:
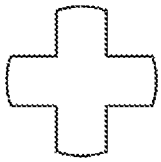
Figure 9:
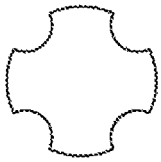
Figure 9:
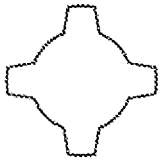
Figure 10:
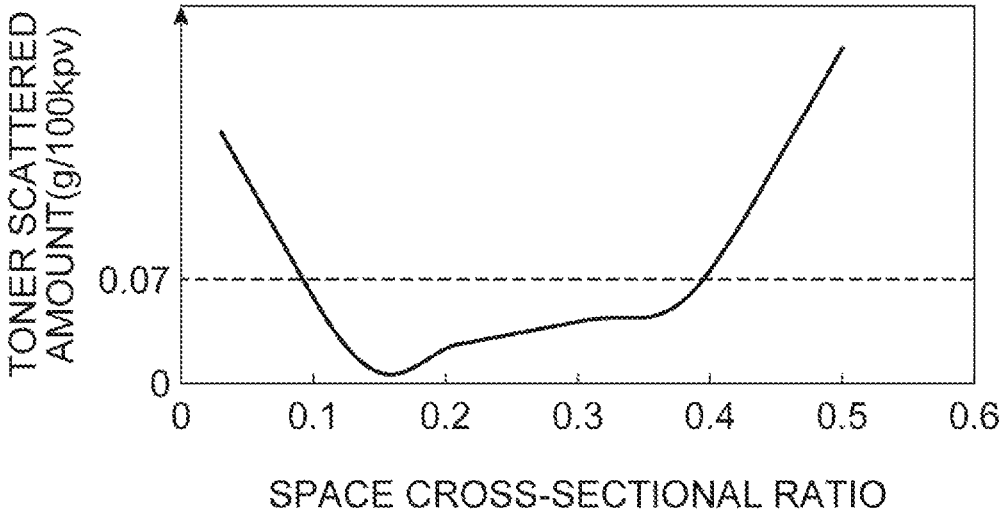
FIG. 10 is a graph showing measurement results.

A relationship between the space cross-sectional ratio (or cross-sectional space ratio) and the toner scattered amount (or amount of toner scattered) has been examined. The cross-sectional space ratio is a ratio (B/A) of an area (B) of a space with respect to an area (A) of the circumscribed circle of the first rod portion 103 in a cross-section orthogonal to the rotational axis 26A of the air flow generator 26 in the first rod portion 103. For example, the cross-sectional space ratio may indicate a ratio of a space in the rotation orbit of the air flow generator 26. The space corresponds to a portion without the first rod portion 103 in a cross-section orthogonal to the rotational axis 26A of the air flow generator 26. Accordingly, the area (B) of the space is a value obtained by subtracting the area of the first rod portion 103 from the area (A) of the circumscribed circle of the first rod portion 103 in the cross-section orthogonal to the rotational axis 26A of the air flow generator 26. The toner scattered amount was measured by using five air flow generators 26 having different cross-sectional space ratios as samples. Cross-sectional shapes of the first rod portions 103 of the air flow generators 26 were set to samples a to e of FIG. 9. The cross-sectional space ratio of the first rod portion 103 of the sample a was 0.03, the cross-sectional space ratio of the first rod portion 103 of the sample b was 0.15, the cross-sectional space ratio of the first rod portion 103 of the sample c was 0.3, the cross-sectional space ratio of the first rod portion 103 of the sample d was 0.2, and the cross-sectional space ratio of the first rod portion 103 of the sample e was 0.35. The toner scattered amount was measured as follows. The toner accumulated on the upper portion of the storage container 21 at the time of rotating the developer carrier 24 while stopping the image carrier 40 was collected and the weight of the collected toner was measured. The speed was set to 80 pv per minute and the measurement time was set to 30 minutes, where pv indicates a number of prints. A toner scattered amount of 2.4 kpv was measured. The measurement result is shown in FIG. 10. The results of the toner scattered amount illustrated in the figures following FIG. 10, are obtained by converting the toner weight measurement results into 100 kpv. That is, the results of the toner scattered amount illustrated in the figures following FIG. 10 are obtained as Toner Weight Measurement Result for 30 minutes×100×1000/80/30. The unit pv may refer to the number of prints.

As shown in FIG. 10, when the cross-sectional space ratio was between 0.1 and 0.4 and was between 10% and 40% in percentage, the toner scattered amount was 0.07 g/100 kpv or less. The value of 0.07 g/100 kpv is an example of a target value of the toner scattered amount. Accordingly, a suitable air flow can be generated by the air flow generator 26 when the cross-sectional space ratio is 0.1 or more and the air flow can be prevented from becoming too fast so that the toner is prevented from leaking to the outside when the cross-sectional space ratio is 0.4 or less. From such a result, the cross-sectional space ratio may be between 0.1 and 0.4.

Figure 11:
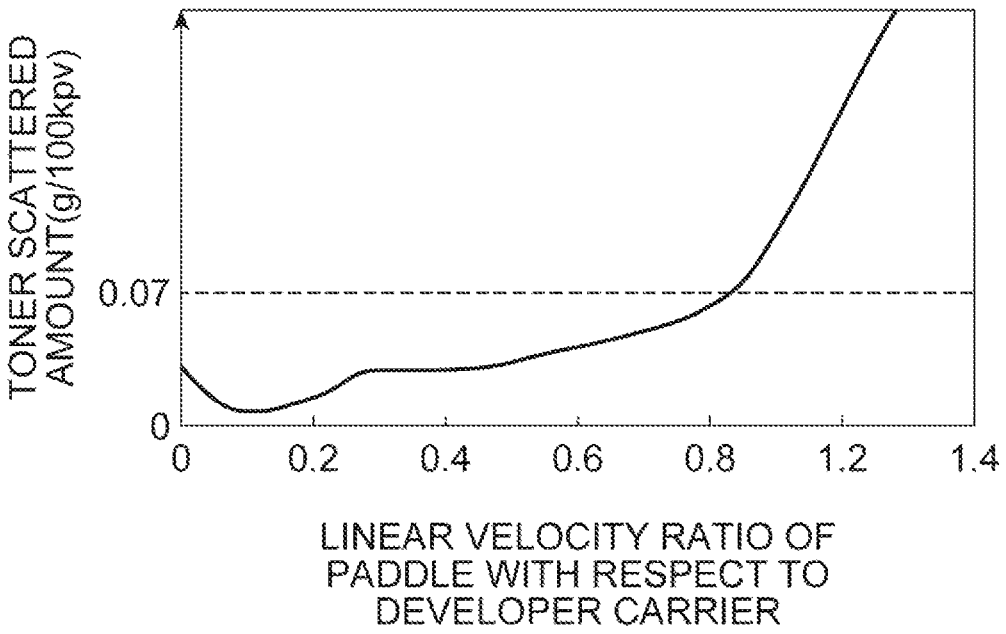
FIG. 11 is a graph showing measurement results.
Figure 12:
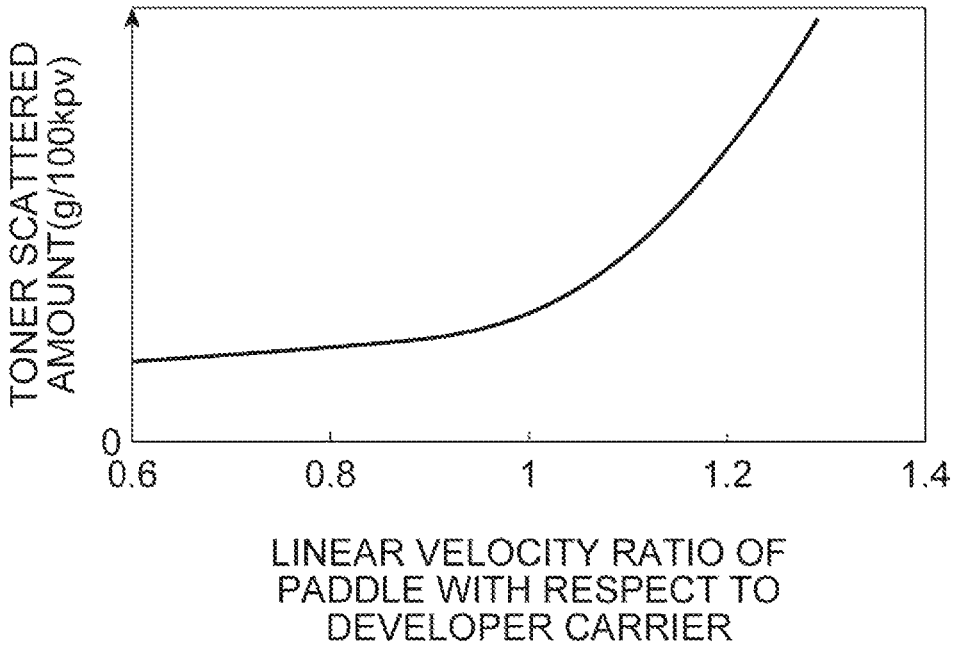
FIG. 12 is a graph showing measurement results.
Figure 13:
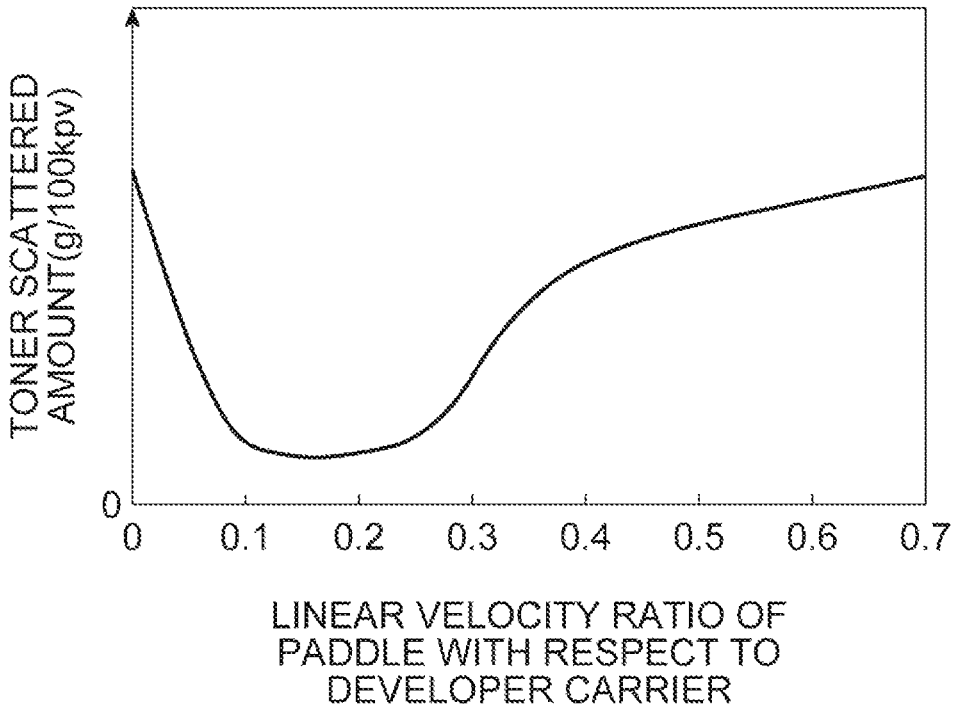
FIG. 13 is a graph showing measurement results.

A relationship between a ratio (D/C) of the linear velocity (D) of the outer circumferential end of the paddle 101 with respect to the linear velocity (C) of the surface of the developer carrier 24 and a toner scattered amount was examined. The air flow generator 26 illustrated in FIGS. 6 and 7 was used. A ratio of the linear velocity of the outer circumferential end of the paddle 101 with respect to the linear velocity of the surface of the developer carrier 24 is referred to as a linear velocity ratio. The toner scattered amount was measured as described above. The measurement result is shown in FIGS. 11 to 13. FIGS. 12 and 13 are enlarged views of a part of FIG. 11.

As shown in FIG. 11, the toner scattered amount was 0.07 g/100 kpv or less when the linear velocity ratio was 1 or less. 0.07 g/100 kpv is an example of a target value of the toner scattered amount. Accordingly, a suitable air flow can be generated by the air flow generator 26 and the air flow can be prevented from becoming too fast so that the toner is prevented from leaking to the outside when the linear velocity ratio is 1 or less. From such a result, the linear velocity ratio may be 1 or less.

As shown in FIGS. 12 and 13, when the linear velocity ratio is below 1, the toner scattered amount decrease degree is small for a while. However, the toner scattered amount largely decreased in a range in which the linear velocity ratio is between 0.1 and 0.3. Accordingly, a suitable air flow can be generated by the air flow generator 26 and a suitable air curtain is formed between the developer carrier 24 and the paddle 101 so that the toner is prevented from leaking to the outside when the linear velocity ratio is between 1 mm and 1.7 mm. A suitable amount of the circulating air flow is a minimum amount of flow having an effect of allowing an air flow to pass through the entire space between the developer carrier 24 and the paddle 101 at the most, and preventing air from leaking from the inside at the least. When the amount of the circulating air flow is too high, the toner may be scattered to the outside without completely entering the space between the developer carrier 24 and the paddle 101. Meanwhile, when the amount of the circulating air flow is too low, toner may be scattered since the blowing from the inside cannot be prevented. From such results, the linear velocity ratio may be between 0.1 and 0.3.

A relationship between the toner scattered amount and the closest distance between the developer carrier 24 and the paddle 101 was examined. The air flow generator 26 illustrated in FIGS. 6 and 7 was used. The closest distance between the developer carrier 24 and the paddle 101 indicates a separation distance between the developer carrier 24 and the paddle 101 when the paddle 101 moves closest to the developer carrier 24 by the rotation of the air flow generator 26. The toner scattered amount was measured as described above. The measurement result is shown in FIG. 14.

Figure 14:
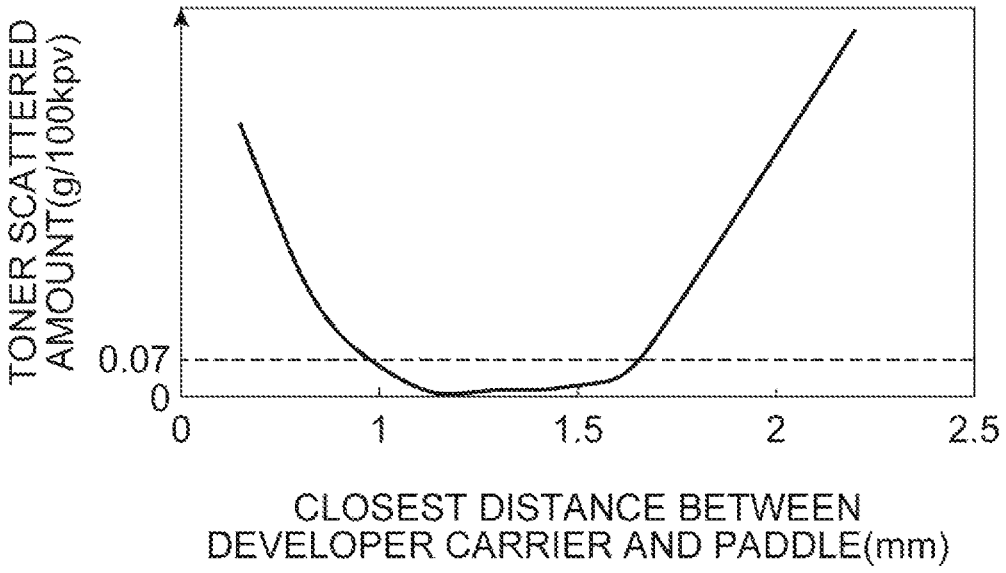
FIG. 14 is a graph showing measurement results.

As shown in FIG. 14, the toner scattered amount was 0.07 g/100 kpv or less when the closest distance between the developer carrier 24 and the paddle 101 was between 1 mm and 1.7 mm. 0.07 g/100 kpv is an example of a target value of the toner scattered amount. Accordingly, a suitable air flow can be generated by the air flow generator 26 and a suitable air curtain is formed between the developer carrier 24 and the paddle 101 so that the toner is prevented from leaking to the outside when the closest distance between the developer carrier 24 and the paddle 101 is between 1 mm and 1.7 mm. For this reason, the closest distance between the developer carrier 24 and the paddle 101 may be between 1 mm and 1.7 mm.

Figure 15:
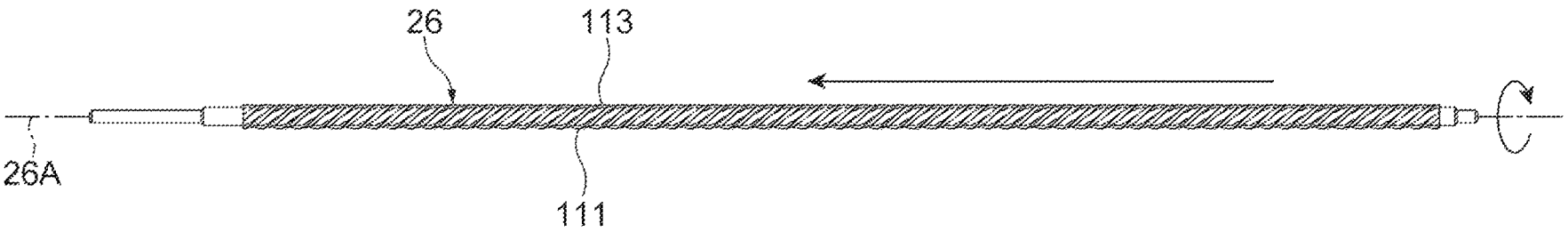
FIG. 15 is a plan view of an example air flow generator.
Figure 16:
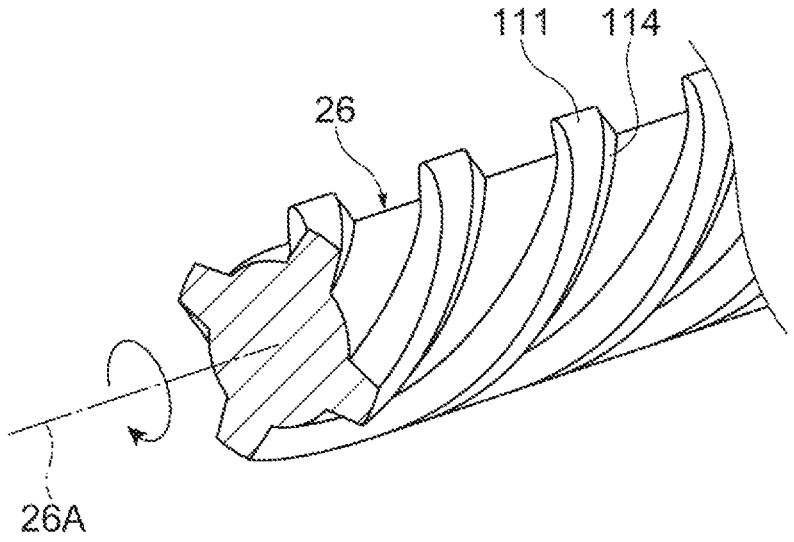
FIG. 16 is an enlarged perspective view illustrating a portion of the example air flow generator of FIG. 15.

With reference to FIGS. 15 and 16, the air flow generator 26 may include a blade 111 which extends helically around the rotational axis 26A of the air flow generator 26. The blade 111 may rotate as the air flow generator 26 rotates, so that an air flow is fed to a gap between the blade and the storage container 21 and the air flow is also fed in a direction parallel to the rotational axis 26A of the air flow generator 26. For example, the blade 111 may be formed in the entire region of the air flow generator 26 excluding both end portions of the air flow generator 26 in the direction along the rotational axis 26A of the air flow generator 26. A portion provided with the blade 111 in the air flow generator 26 may be referred to as a second rod portion 113.

The blade 111 may include a propulsion surface 114 which feeds an air flow to a gap between the blade and the storage container 21 and also feeds the air flow in a direction parallel to the rotational axis 26A of the air flow generator 26. The propulsion surface 114 is a front surface of the blade 111 in the rotational direction of the air flow generator 26. The shape of the propulsion surface 114 is not particularly limited. In some examples, the propulsion surface 114 may be flat, curved, or stepped. The propulsion surface 114 may extend substantially in the radial direction with respect to the rotational axis 26A of the air flow generator 26.

The blade 111 may be shaped by forming a groove having a helically shape around the rotational axis 26A of the air flow generator 26 in a bar-shaped member that has a circular cross-section and that extends along the rotational axis 26A of the air flow generator 26. The propulsion surface 114 of the blade 111 may extend helically around the rotational axis 26A of the air flow generator 26.

Accordingly, the air flow generator 26 may include the blade 111, to feed an air flow to a gap between the air flow generator and the storage container 21 and to feed the air flow in a direction parallel to the rotational axis 26A of the air flow generator 26. Accordingly, the air flow is fed from a position in which the toner concentration easily occurs (or where toner easily collects) to a position in which the toner concentration hardly occurs (or where toner hardly collects) in a direction parallel to the rotational axis 26A of the air flow generator 26, which prevents an accumulation of toner, in turn preventing the toner from being scattered from the storage container 21. Accordingly, the toner is prevented from being scattered from the storage container 21 by preventing the concentration of the toner. In some examples, the second mixing and conveying member 23 supplies a developer to the developer carrier 24 along the second conveying path in the developer storage chamber H, to collect toner at the downstream side of the developer conveying direction of the second mixing and conveying member 23. Accordingly, the toner easily concentrates (or accumulates) at the downstream side in the developer conveying direction of the second mixing and conveying member 23. The helical direction of the blade 111 may be set so as to feed an air flow in a direction opposite to the developer conveying direction of the second mixing and conveying member 23, where the opposite direction is parallel to the rotational axis 26A of the air flow generator 26, in order to reduce the concentration (or accumulation) of the toner and thereby inhibit the scattering of toner from the storage container 21.

Figure 17:
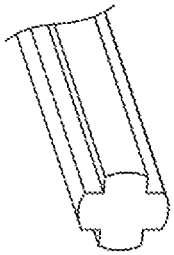
FIG. 17 is a diagram illustrating a relationship between shapes of the air flow generator and feed amounts.
Figure 17:
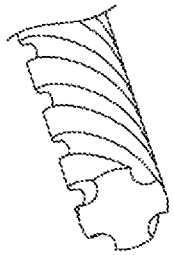
Figure 17:
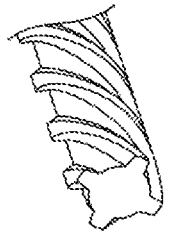

A relationship between the toner scattered amount and the air feed amount in a direction parallel to the rotational axis 26A of the air flow generator 26 has been examined. In the following, an air feed amount in a direction parallel to the rotational axis 26A of the air flow generator 26 may be referred to as a "feed amount". The toner scattered amount was measured by using three air flow generators 26 having different feed amounts as samples. The shape of the second rod portion 113 of each air flow generator 26 was set to samples f to h of FIG. 17. The air flow generator 26 of the sample f includes a paddle 101 (e.g., instead of the blade 111). For this reason, the feed amount of the sample f was 0 $mm^3$/min. The feed amount of the second rod portion 113 shown in the sample g was 150 $mm^3$/min and the feed amount of the second rod portion 113 shown in the sample h was 200 $mm^3$/min. The air flow generators 26 of the sample g and the sample h were configured to feed the air flow in a direction opposite to the developer conveying direction of the second mixing and conveying member 23. The toner scattered amount was measured as described above. The measurement result is shown in FIG. 18.

Figure 18:
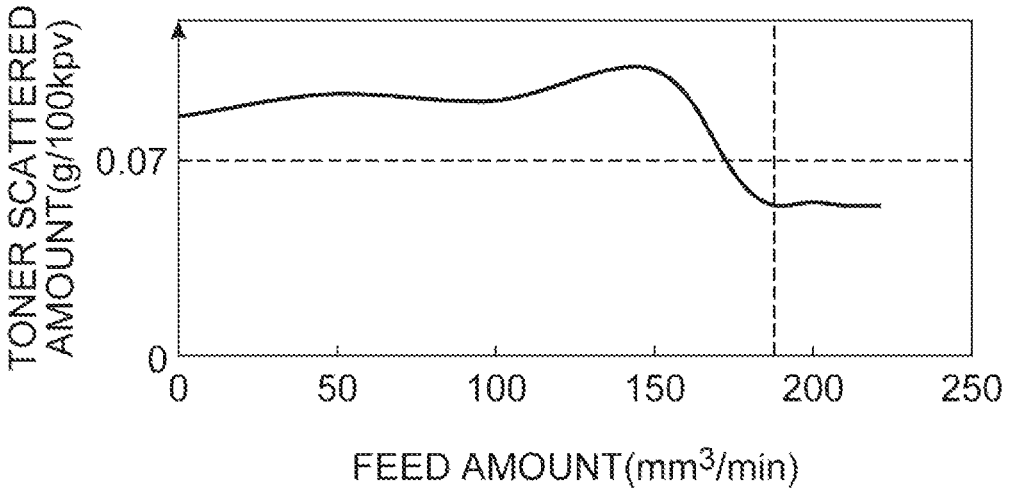
FIG. 18 is a graph showing measurement results.

With reference to FIG. 18, the toner scattered amount decreased when the feed amount exceeded 150 $mm^3$/min, the toner scattered amount changed 0.07 g/100 kpv or less when the feed amount changed 165 $mm^3$/min or more, and the toner scattered amount stabilized to 0.07 g/100 kpv or less when the feed amount was 180 $mm^3$/min or more. 0.07 g/100 kpv is an example of a target value of the toner scattered amount. Accordingly, the concentration of the toner due to the conveying of the developer by the second mixing and conveying member 23 is reduced so that the toner is prevented from leaking to the outside when the feed amount is between 165 $mm^3$/min and 180 $mm^3$/min. From such a result, the shape of the blade 111 may be set so that the feed amount is between 165 $mm^3$/min and 180 $mm^3$/min.

Figure 19:
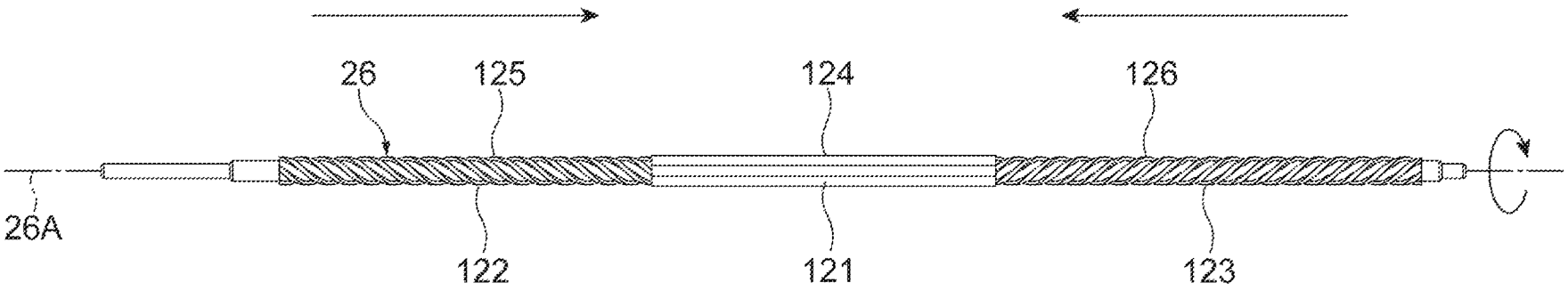
FIG. 19 is a plan view of an example air flow generator.
Figure 20C:
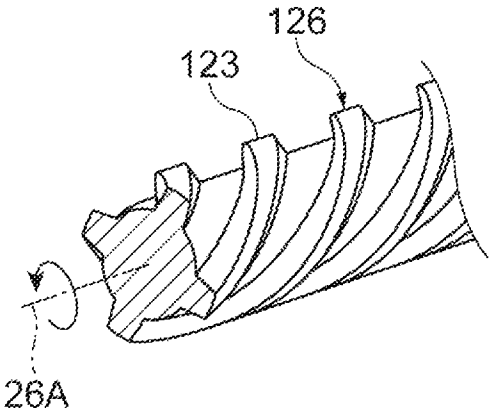
FIG. 20(*a*) is a partial perspective view of a first blade forming portion of the air flow generator illustrated in FIG. 19.
Figure 20B:
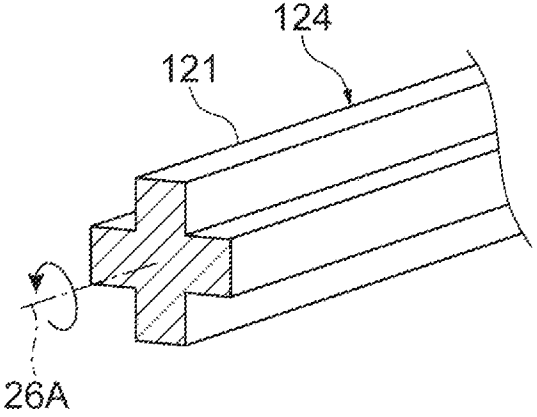
Figure 20A:
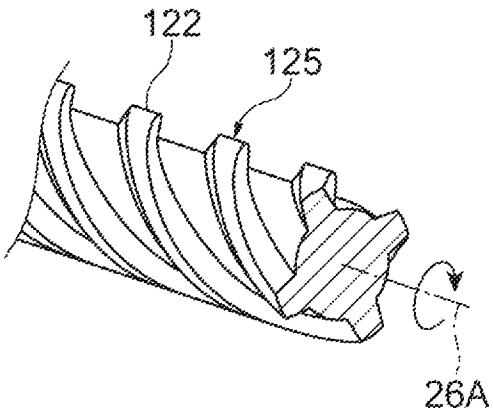

With reference to FIGS. 19 and 20, the air flow generator 26 may include both a first structure similar to the paddle 101, and a second structure similar to the blade 111.

With reference to FIGS. 19 and 20, the air flow generator 26 may include a paddle forming portion 124 located at a center portion in the direction along the rotational axis 26A of the air flow generator 26, which rotates about the rotational axis 26A of the air flow generator 26 and. The air flow generator 26 may further include a first blade forming portion 125 including a blade 122, and a second blade forming portion 126 including a blade 123. The first blade forming portion 125 and the second blade forming portion 126 may be located at both sides of the paddle forming portion 124 in the direction along the rotational axis 26A of the air flow generator 26 and extending helically around the rotational axis 26A of the air flow generator 26. The paddle 121 is similar to the paddle 101. The blade 122 and the blade 123 are similar to the blade 111.

Then, the helical direction of the blade 122 formed in the first blade forming portion 125 and the helical direction of the blade 123 formed in the second blade forming portion 126 are set to opposite directions and directions in which the air flow is fed to the paddle forming portion 124 when the air flow generator 26 rotates.

Accordingly, when the air flow generator 26 rotates, the paddle 121 of the paddle forming portion 124, the blade 122 of the first blade forming portion 125, and the blade 123 of the second blade forming portion 126 feed the air flow to a gap between the air flow generator 26 and the storage container 21 while moving the air flow toward the center side in the direction parallel to the rotational axis 26A of the air flow generator 26.

The storage container 21 and the developer carrier 24 may face the image carrier 40, to more easily discharge the toner discharged from the storage container 21, to both sides in a direction parallel to the rotational axis 24A of the developer carrier 24. Accordingly, the air flow is moved toward the center side in a direction parallel to the rotational axis 26A of the air flow generator 26 by the blade 122 and the blade 123, thereby preventing the scattering of the toner.

Figure 21:
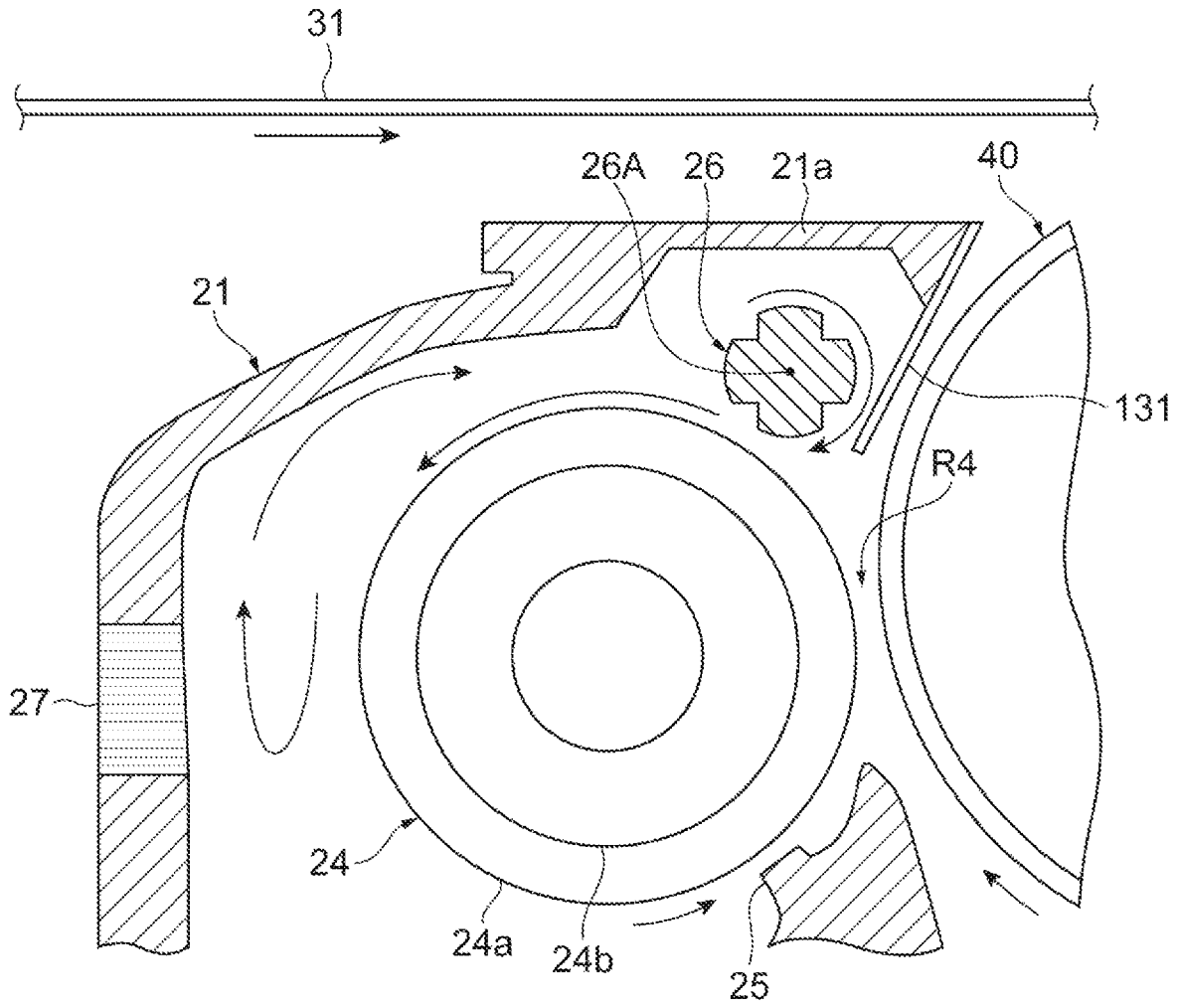
FIG. 21 is a schematic cross-sectional view of an example developing device.

In some examples, with reference to FIG. 21, the developing device 20 may include a guide member 131 that extends between the image carrier 40 and the air flow generator 26.

The guide member 131 may be provided in the storage container 21 and extend from the storage container 21 between the image carrier 40 and the air flow generator 26. The guide member 131 may be spaced apart from the air flow generator 26 so that the air flow passes between the guide member 131 and the air flow generator 26. The guide member 131 may be spaced apart from the image carrier 40 so that the air flow passes between the guide member 131 and the image carrier 40. The guide member 131 may form a channel from the outside of the storage container 21 to the developing region R4 while being separated from the image carrier 40.

The guide member 131 may be formed by a thin plate-shaped member such as a PET film having a thickness of about 0.05 to 0.5 mm or a urethane rubber sheet having a thickness of about 0.1 to 0.5 mm. The guide member 131 may be formed integrally with the storage container 21 or may be formed separately from the storage container 21. In a case in which the guide member 131 is formed separately from the storage container 21, the guide member 131 may be detachably attached to the storage container 21 in an attachable/detachable manner via fitting, screwing, or the like.

A front end of the guide member 131 may be located between the image carrier 40 and the air flow generator 26 or may be located near the developer carrier 24 in relation to a gap between the image carrier 40 and the air flow generator 26.

Accordingly, the air flow passing through a gap between the air flow generator 26 and the storage container is guided toward a gap between the air flow generator 26 and the developer carrier 24 by the guide member 131, in order to prevent the scattering of the toner due to the discharge of the air flow to the outside of the developing device 20.

In some examples, the transfer belt 31 is disposed at the opposite side of the developing region R4 with respect to the air flow generator 26, and air flow generated by the driving of the transfer belt 31 may flow into a gap between the air flow generator 26 and the image carrier 40. In addition, the guide member 131 extends between the image carrier 40 and the air flow generator 26, to prevent the air flow in the periphery of the air flow generator 26 from being disturbed by the air flow accompanied by the driving of the transfer belt 31.

The guide member 131 may serve as a curtain when the speed of the air flow in the periphery of the air flow generator 26 increases excessively, in order to prevent the air flow from flowing to the outside of the developing device 20. Accordingly, it is possible to prevent the scattering of the toner.

A relationship between the toner scattered amount and the closest distance between the guide member 131 and the developer carrier 24 has been examined. The closest distance between the guide member 131 and the developer carrier 24 is a separation distance between the developer carrier 24 and a position in which the guide member 131 is closest to the developer carrier 24. The toner scattered amount was measured as described above. The measurement result is shown in FIG. 22.

Figure 22:
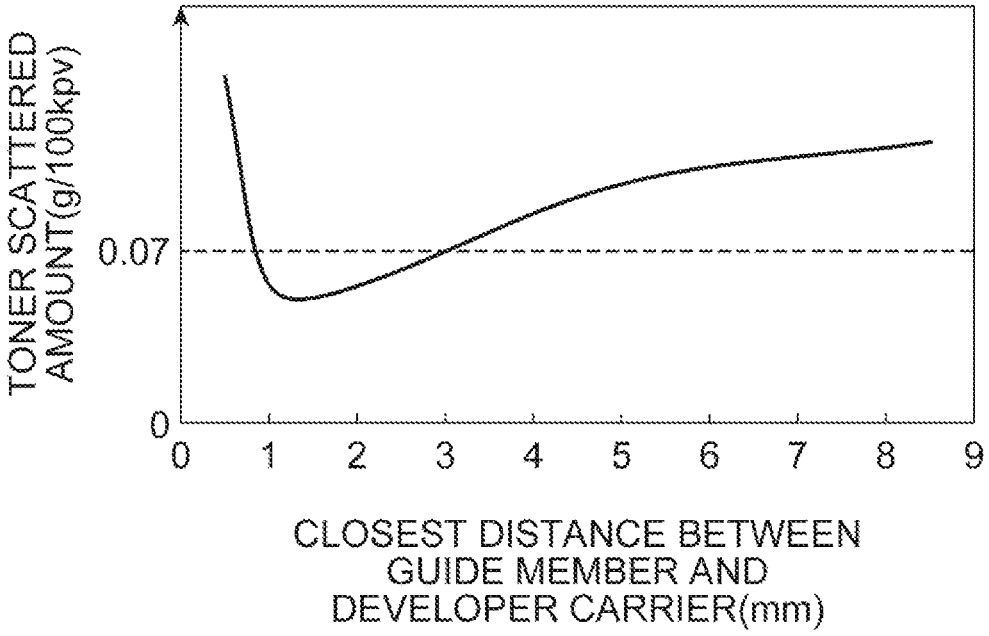
FIG. 22 is a graph showing measurement results.

As shown in FIG. 22, the toner scattered amount was 0.07 g/100 kpv or less when the closest distance between the guide member 131 and the developer carrier 24 was between 1 mm and 3 mm. 0.07 g/100 kpv is an example of a target value of the toner scattered amount. Accordingly, a suitable air flow can be generated by the air flow generator 26 and a suitable air curtain is formed between the developer carrier 24 and the paddle 101 so that the toner is prevented from leaking to the outside when the closest distance between the guide member 131 and the developer carrier 24 between 1 mm and 3 mm. Accordingly, the closest distance between the guide member 131 and the developer carrier 24 may be between 1 mm and 3 mm.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. An imaging system comprising:

a rotatable image carrier;

a rotatable developer carrier, to transfer toner to the image carrier at a developing region located between the image carrier and the developer carrier;

a storage container to store the developer carrier; and an air flow generator disposed to be separated from the storage container by a gap interposed between the rotatable image carrier, the rotatable developer carrier and an upper wall of the storage container, the air flow generator is to rotate in a rotational direction that is opposite to a rotational direction of the developer carrier, and to channel an air flow through the gap to discharge the air flow outside of the storage container and to reintroduce airflow flowing from the outside to inside the storage container, the air flow generator includes a rod portion that includes a space area that is unoccupied by the rod portion to form a paddle portion extending along a rotational axis of the air flow generator, a ratio of the space area relative to an entire area of a circumscribed circle of the first type of rod portion in a cross-section of the rod portion, taken orthogonally to the rotational axis, is between approximately 0.1 and 0.4.

2. The imaging system according to claim 1, wherein the paddle portion comprises a propulsion surface that extends in a direction substantially radial to a rotational axis of the air flow generator.

3. The imaging system according to claim 2, wherein the propulsion surface of the paddle portion extends parallel to the rotational axis of the air flow generator.

4. The imaging system according to claim 1, wherein a ratio of a linear velocity of an outer circumferential end of the paddle portion with respect to a linear velocity of a surface of the developer carrier is 1 or less.

5. The imaging system according to claim 1, wherein a closest distance between the rod portion and the developer carrier is between approximately 1 mm and 1.7 mm.

6. The imaging system according to claim 1, wherein the paddle portion forms a blade extending helically around a rotational axis of the rod portion.

7. The imaging system according to claim 1, wherein the rod portion includes:

the paddle portion extending along a rotational axis of the air flow generator from a first end to a second end;

the paddle portion in form of a first blade portion extending from the first end of the paddle portion along the rotational axis, the first blade portion including a first blade that extends in a first helical direction around the rotational axis; and the paddle portion in form of a second blade forming portion extending from the second end of the paddle portion along the rotational axis, the second blade portion including a second blade that extends in a second helical direction around the rotational axis, and wherein the first helical direction of the first blade portion is opposite the second helical direction of the second blade portion, to feed the air flow to the paddle portion when the air flow generator rotates.

8. The imaging system according to claim 1, wherein the air flow generator is located adjacent a downstream side of the developing region, the downstream side relative to the rotational direction of the developer carrier.

9. An imaging system comprising:

a rotatable image carrier;

a rotatable developer carrier, to transfer toner to the image carrier at a developing region located between the image carrier and the developer carrier;

a storage container to store the developer carrier; and an air flow generator disposed to be separated from the storage container by a gap interposed between the rotatable image carrier, the rotatable developer carrier and an upper wall of the storage container, the air flow generator is to rotate in a rotational direction that is opposite to a rotational direction of the developer carrier, and to channel an air flow through the gap to discharge the air flow outside of the storage container and to reintroduce airflow flowing from the outside to inside the storage container, the air flow generator includes a rod portion that includes including a space area that is unoccupied by the rod portion to form a paddle portion extending along a rotational axis of the air flow generator, a ratio of the space area relative to an entire area of a circumscribed circle of the first type of rod portion in a cross-section of the rod portion, taken orthogonally to the rotational axis, is between approximately 0.1 and 0.4, the storage container includes a guide member extending between the image carrier and the air flow generator to prevent scattering of the toner due to the discharge of the air flow to the outside and to form a channel from the outside of the storage container to the developing region.

10. The imaging system according to claim 9, wherein the guide member is separated from the air flow generator to allow the air flow to pass between the guide member and the air flow generator.

11. The imaging system according to claim 9, wherein the guide member is separated from the image carrier, forming a channel from outside of the storage container to the developing region.

12. The imaging system according to claim 9, wherein a closest distance between the guide member and the developer carrier is between approximately 1 mm and 3 mm.

13. An imaging system comprising:

a rotatable image carrier, to transfer a toner image to an endless belt;

a rotatable developer carrier, to transfer toner to the image carrier at a developing region located between the image carrier and the developer carrier;

a storage container to store the developer carrier; and an air flow generator located within the storage container between the developing region and the endless belt, wherein, the air flow generator is disposed to be separated from the storage container by a by a gap interposed between the rotatable image carrier, the rotatable developer carrier and an upper wall of the storage container, the air flow generator is to rotate in a rotational direction that is opposite to a rotational direction of the developer carrier, and to channel an airflow through the gap to discharge the air flow outside of the storage container and to reintroduce airflow flowing from the outside to inside the storage container, the air flow generator includes a rod portion that includes a space area that is unoccupied by the rod portion to form a paddle portion extending along a rotational axis of the air flow generator, a ratio of the space area relative to an entire area of a circumscribed circle of the first type of rod portion in a cross-section of the rod portion, taken orthogonally to the rotational axis, is between approximately 0.1 and 0.4.

14. The imaging system according to claim 13, wherein the paddle portion comprises a propulsion surface that extends in a direction substantially radial to a rotational axis of the air flow generator.

15. The imaging system according to claim 14, wherein the propulsion surface of the paddle portion extends parallel to the rotational axis of the air flow generator.

16. The imaging system according to claim 13, wherein the paddle portion forms a blade extending helically around a rotational axis of the rod portion.

* * * * *